US009299307B2

(12) United States Patent
Hiraga

(10) Patent No.: US 9,299,307 B2
(45) Date of Patent: Mar. 29, 2016

(54) IMAGE DISPLAY DEVICES, IMAGE DISPLAY SYSTEMS, AND IMAGE SIGNAL PROCESSING METHODS

(75) Inventor: Takashi Hiraga, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 14/347,208

(22) PCT Filed: Sep. 26, 2011

(86) PCT No.: PCT/JP2011/071810

§ 371 (c)(1),
(2), (4) Date: Mar. 25, 2014

(87) PCT Pub. No.: WO2013/046288

PCT Pub. Date: Apr. 4, 2013

(65) Prior Publication Data

US 2014/0232714 A1 Aug. 21, 2014

(51) Int. Cl.
*G09G 3/36* (2006.01)
*G09G 3/00* (2006.01)

(52) U.S. Cl.
CPC ..... *G09G 3/3677* (2013.01); *G09G 3/002* (2013.01); *G09G 3/3611* (2013.01); *G09G 2300/026* (2013.01); *G09G 2320/0261* (2013.01); *G09G 2320/103* (2013.01); *G09G 2320/106* (2013.01)

(58) Field of Classification Search
CPC ..... G09G 3/36; G09G 2360/16; G09G 2320/0233; G09G 2320/02; G09G 3/002; G09G 3/3611; G09G 3/3677; G09G 2300/26; G09G 2320/103; G09G 2320/106; G09G 2320/0261
See application file for complete search history.

(56) References Cited

U.S. PATENT DOCUMENTS

2004/0233157 A1 11/2004 Sekiya et al.
2006/0279489 A1* 12/2006 Ouchi et al. ..... 345/76
2011/0157209 A1* 6/2011 Saito ..... 345/589

FOREIGN PATENT DOCUMENTS

JP 2003-345285 A 12/2003
JP 2006-201544 A 8/2006
JP 2006-343556 A 12/2006
JP 2008-107818 A 5/2008
JP 2011-048379 A 3/2011

OTHER PUBLICATIONS

International Search Report (ISR) (PCT Form PCT/ISA/210), in PCT/JP2011/071810, dated Dec. 27, 2011.

* cited by examiner

*Primary Examiner* — MD Saiful A Siddiqui
(74) *Attorney, Agent, or Firm* — McGinn IP Law Group PLLC

(57) ABSTRACT

Image display devices that can eliminate image deterioration that occurs due to a pixel scanning sequence are provided. A detection section identifies a moving region contained in an image corresponding to an input image signal composed of a plurality of frames and detects a moving distance and a moving direction for and in which the moving region moves. A correction section corrects the image signal based on a detected result of the detection section and the scanning sequence in which individual pixels in the moving region are scanned. A drive section scans the plurality of pixels in the scanning sequence based on a corrected image signal that is an image signal corrected by the correction section and draws a corrected image corresponding to the corrected image signal.

9 Claims, 10 Drawing Sheets

| Scanning lines numbers | Horizontal scanning sequence |
|---|---|
| 1 | 1 |
| 2 | 2 |
| 3 | 3 |
| 4 | 4 |
| 5 | 5 |
| 6 | 6 |
| 7 | 7 |
| 8 | 8 |
| ⋮ | ⋮ |
| n/2-3 | n/2-3 |
| n/2-2 | n/2-2 |
| n/2-1 | n/2-1 |
| n/2 | n/2 |
| n/2+1 | n/2+1 |
| n/2+2 | n/2+2 |
| n/2+3 | n/2+3 |
| n/2+4 | n/2+4 |
| ⋮ | ⋮ |
| n-7 | n-7 |
| n-6 | n-6 |
| n-5 | n-5 |
| n-4 | n-4 |
| n-3 | n-3 |
| n-2 | n-2 |
| n-1 | n-1 |
| n | n |

IMAGE DISPLAY DEVICES, IMAGE DISPLAY SYSTEMS, AND IMAGE SIGNAL PROCESSING METHODS

TECHNICAL FIELD

The present invention relates to image display devices, image display systems, and image display methods that display images, in particular, to those that are provided with a liquid crystal panel that displays images.

BACKGROUND ART

Some image display devices such as liquid crystal monitors and liquid crystal projectors are provided with a display panel having a plurality of pixels, scan these pixels in a predetermined scanning sequence, and draw images.

FIG. 1 is a schematic diagram showing the structure of the foregoing image display device. As shown in FIG. 1, the image display device has liquid crystal panel 101, horizontal drive circuit 102, sample hold circuit 103, and vertical drive circuit 104.

Liquid crystal panel 101 has a plurality of scanning lines SCN; a plurality of signal lines SIG that intersect with individual scanning lines SCN; and a plurality of pixels PX that are located respectively at intersections of individual scanning lines SCN and individual signal lines SIG. Each pixel PX is composed of a liquid crystal cell and is connected to scanning line SCN and signal line SIG through transistor TFT. More specifically, a gate electrode of transistor TFT is connected to scanning line SCN; a source electrode thereof is connected to signal line SIG; and a drain electrode thereof is connected to pixel PX.

Horizontal drive circuit 102 starts operating in synchronization with a horizontal synchronization signal for an image signal and outputs a sampling signal that causes the image signal to be sampled to sample hold circuit 103 in synchronization with an input clock signal.

Sample hold circuit 103 samples pixel values of individual scanning lines of the image signal in synchronization with the sampling signal that is input from horizontal drive circuit 102 and holds pixel values of one scanning line of the image signal. Thereafter, sample hold circuit 103 outputs pixel voltages corresponding to the pixel values that have been held to individual signal lines SIG.

Vertical drive circuit 104 applies the pixel voltages that are input from sample hold circuit 103 to pixels PX connected to individual scanning lines SCN so as to scan pixels PX of individual scanning lines SCN.

More specifically, vertical drive circuit 104 outputs vertical scanning timing pulses that cause transistors TFT to be turned on to individual scanning lines SCN in a predetermined sequence at timings corresponding to the horizontal synchronization signal and vertical synchronization signal for the image signal, turns on transistors TFT connected to individual scanning lines SCN, and thereby applies the pixel voltages to individual pixels PX.

FIG. 2 is a timing chart showing timings at which the vertical scanning timing pulses are output. FIG. 3 is a schematic diagram showing a horizontal scanning sequence in which scanning lines SCN are scanned corresponding to the vertical scanning timing pulses. In FIG. 2 and FIG. 3, it is assumed that the number of scanning lines SCN is n and they are assigned scanning line numbers 1 to n that are in sequence from top to bottom on liquid crystal panel 101.

As shown in FIG. 2 and FIG. 3, vertical drive circuit 104 starts operating in synchronization with the vertical synchronization signal and outputs vertical scanning timing pulses to individual scanning lines SCN that are in sequence from top to bottom on liquid crystal panel 101 in synchronization with the horizontal synchronization signal. As a result, individual pixels PX are successively scanned corresponding to individual scanning lines SCN that are in sequence from top to bottom on liquid crystal panel 101.

In the image display device provided with liquid crystal panel 101, liquid crystal cells do not quickly respond to pixel voltages. In addition, a display image remains displayed for one frame period of the image signal. Thus, when a moving image is displayed, an afterimage of each frame of the image signal and the image of the next frame are mixed with each other and thereby a so-called moving blur where the viewer sees a blurred image may occur.

In contrast, Patent Literature 1 describes an image processing device that can eliminate a moving blur.

The image processing device described in Patent Literature 1 detects the position of an object that is moving in a display image and the amount of that the object has moved based on two successive frames of an image signal and corrects the image signal based on the detected result so as to eliminate the moving blur. More specifically, the image processing device adds a correction values to pixel values of pixels located between the position before the object is moved and the position after it is moved so as to offset the afterimage and thereby eliminate the moving blur.

RELATED ART LITERATURE

Patent Literature

Patent Literature 1: JP2011-048379A, Publication

SUMMARY OF THE INVENTION

Problem to be Solved by the Invention

When the image display device shown in FIG. 1 displays a moving image, image deterioration other than the foregoing image blur may occur due to a pixel scanning sequence.

FIG. 4 to FIG. 6 are schematic diagrams describing image deterioration that occurs due to a pixel scanning sequence.

As shown in FIG. 4, it is assumed that vertical line 401 is moving from right to left on display screen 400. In this case, since pixels are scanned corresponding to individual scanning lines SCN that are in sequence from top to bottom on display screen 400, the lower portion of vertical line 401 is drawn later than the upper portion thereof. Thus, as shown in FIG. 5, image deterioration where the viewer may see that the lower portion of vertical line 401 is moving later than the upper portion thereof may occur.

Such image deterioration remarkably occurs in a video wall type image display system that is provided with a plurality of image display devices and displays images generated thereby as one image.

For example, as shown in FIG. 6, in an image display system that arranges four images in a matrix of two horizontal positions and two vertical positions and displays them as one image, if vertical lines 601 is moving from right to left on display image 600, while the lower portion of vertical line 601 of the upper image is drawn late, the upper portion of vertical line 601 of the lower image is drawn fast, the viewer may see that boundaries of vertical lines 601 on the image vertically arranged deviate and thereby significant image deterioration may occur.

The image processing device described in Patent Literature 1 does not consider image deterioration that occurs due to a pixel scanning sequence. The pixel values of pixels between the position before the object is moved and the position after it is moved are corrected regardless of the pixel scanning sequence. Thus, the image processing device described in Patent Literature 1 cannot eliminate such image deterioration.

An object of the present invention is to provide image display devices, image display systems, and driving methods that can eliminate image deterioration that occurs due to a pixel scanning sequence.

Means that Solve the Problem

An image display device according to the present invention is an image display device that is provided with a display panel having a plurality of pixels and that scans said plurality of pixels in a predetermined scanning sequence and draws an image, the image display device including:

a detection section that identifies a moving region contained in an image corresponding to an input image signal composed of a plurality of frames and detects a moving distance and a moving direction for and in which the moving region moves;

a correction section that corrects said image signal based on a detected result of said detection section and the scanning sequence in which individual pixels in said moving region are scanned; and a drive section that scans said plurality of pixels in said scanning sequence based on a corrected image signal that is an image signal corrected by said correction section and draws a corrected image corresponding to said corrected image signal.

An image display system according to the present invention is an image display system that is provided with a plurality of forgoing image display devices.

An image signal processing method according to the present invention is an image signal processing method for an image display device that is provided with a display panel having a plurality of pixels and that scans said plurality of pixels in a predetermined scanning sequence and draws an image, the image signal processing method including:

identifying a moving region contained in an image corresponding to an input image signal composed of a plurality of frames and detecting a moving distance and a moving direction for and in which the moving region moves;

correcting said image signal based on the detected result and the scanning sequence in which individual pixels in said moving region are scanned; and scanning said plurality of pixels in said scanning sequence based on a corrected image signal that is a corrected image signal and drawing a corrected image corresponding to said corrected image signal.

Effect of the Invention

According to the present invention, image deterioration that occurs due to a pixel scanning sequence can be eliminated.

BEST MODES THAT CARRY OUT THE INVENTION

Figure 1:
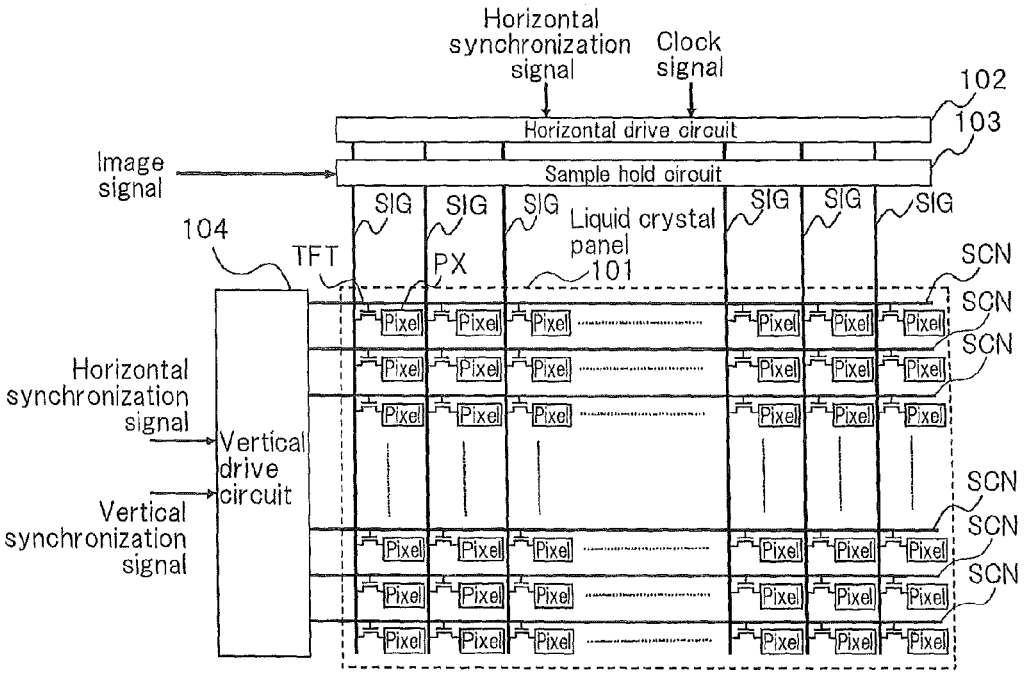
Fig.1 Background Art
FIG. 1 is a schematic diagram showing the structure of an image display device according to a related art reference of the present invention.
Figure 2:
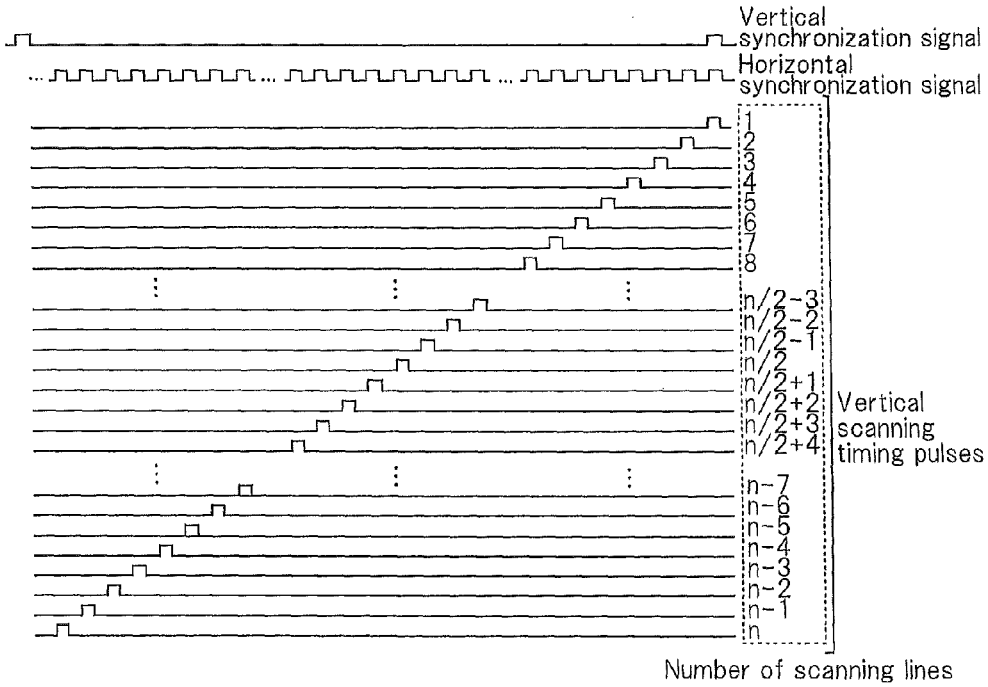
Background Art Fig.2
FIG. 2 is a timing chart showing timings at which the image display device of the related art reference outputs vertical scanning timing pulses.
Figures 3, 4:
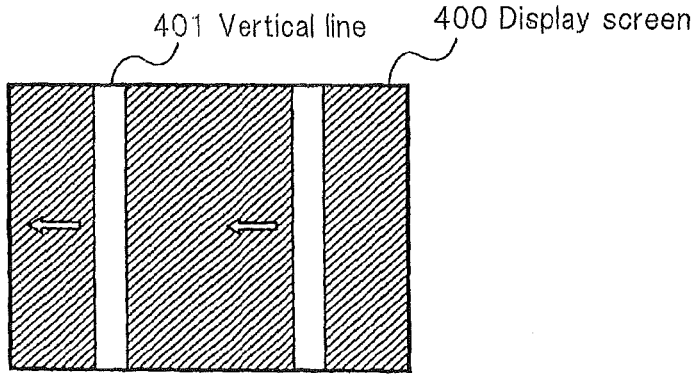
Fig.3 Background Art
Fig.4 Background Art
FIG. 3 is a schematic diagram showing a scanning sequence that is a sequence in which the image display device of the related art reference outputs vertical scanning timing pulses to scanning lines SCN.
FIG. 4 is a schematic diagram showing an example of a display image that the image display device of the related art reference displays.
Figure 5:
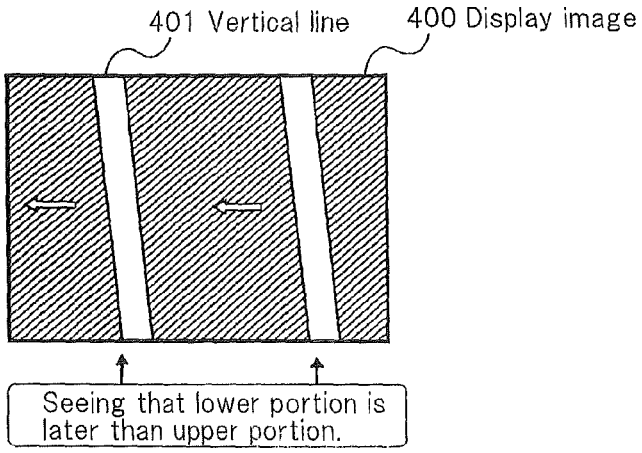
Fig.5 Background Art
FIG. 5 is a schematic diagram describing an example of image deterioration that occurs in the image display device of the related art reference.
Figure 6:
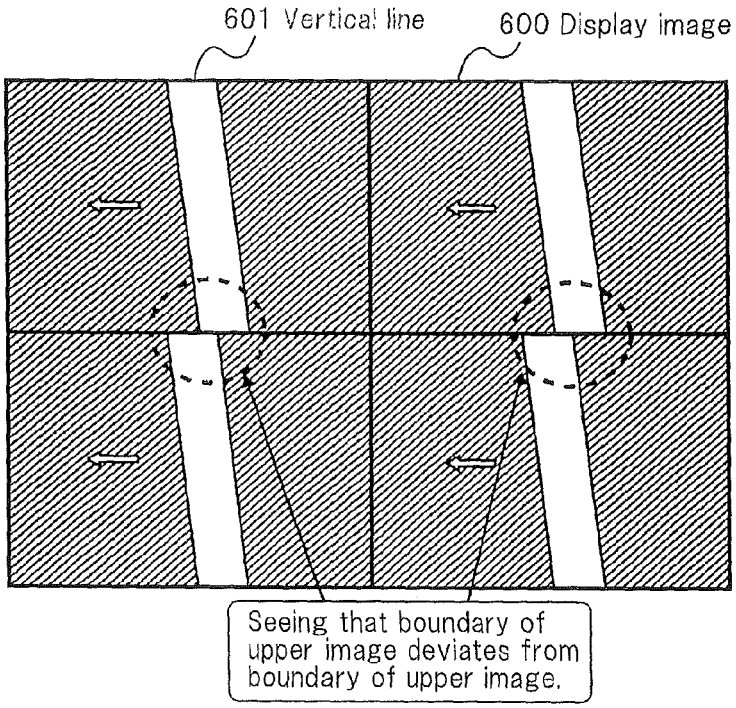
Fig.6 Background Art
FIG. 6 is a schematic diagram describing another example of image deterioration that occurs in the image display device of the related art reference.

Next, with reference to the accompanying drawings, embodiments of the present invention will be described. Similar members having similar functions may be represented by similar reference numerals and their description may be omitted.

Figure 7:
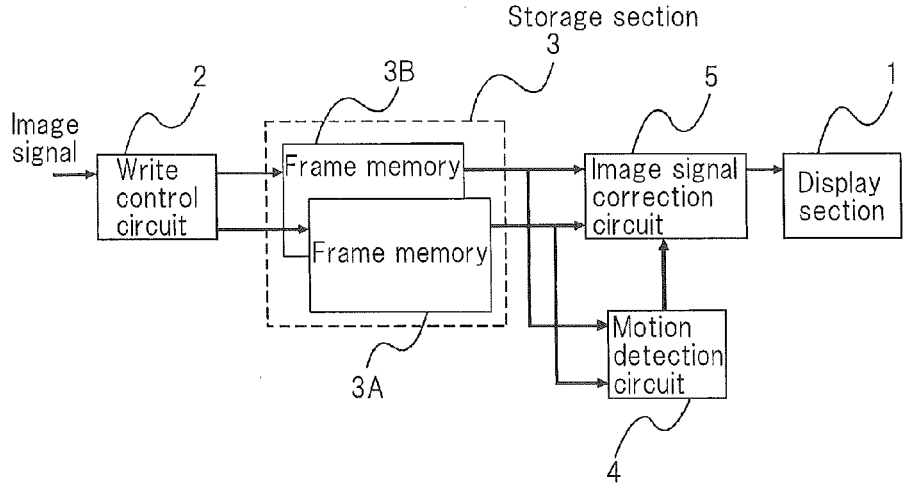
FIG. 7 is a block diagram showing the structure of an image display device according to an embodiment of the present invention.

FIG. 7 is a block diagram showing the structure of an image display device according to this embodiment. In FIG. 7, the image display device has display section 1, write control circuit 2, storage section 3, motion detection circuit 4, and image signal correction circuit 5. The image display device may be a projection type image display device that projects an image on a screen (not shown). Alternatively, the image display device according to this embodiment may be a device (monitor) that is provided with a display screen on which an image is displayed.

Display section 1 is provided with a display panel that has a plurality of pixels. Display section 1 scans the plurality of pixels in a predetermined scanning sequence so as to draw an image.

Figure 8:
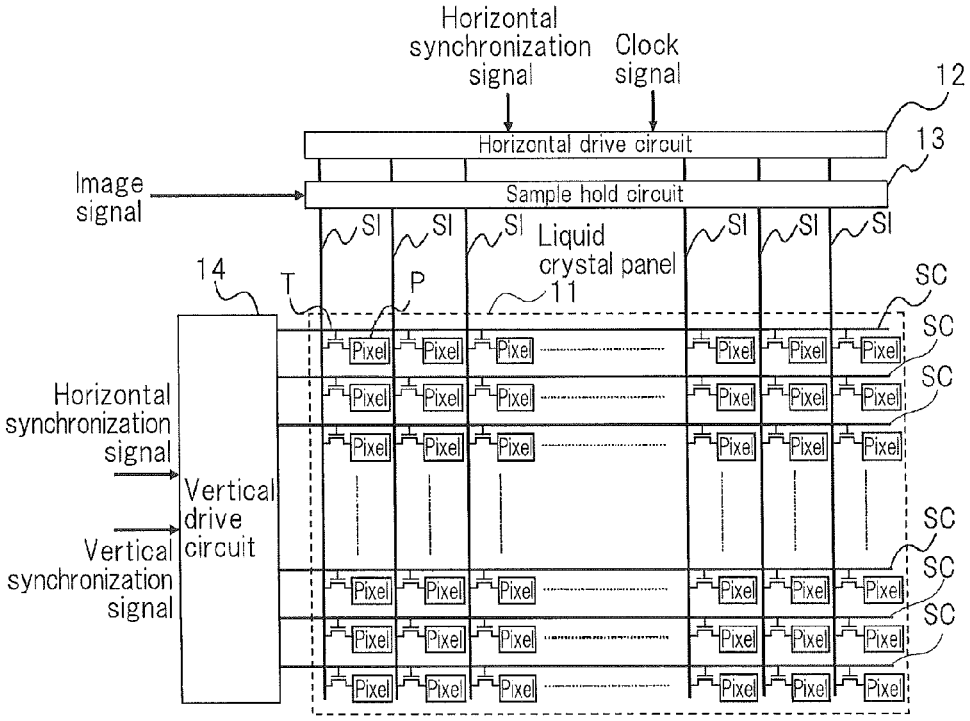
FIG. 8 is a schematic diagram showing an example of the structure of a display section.

FIG. 8 is a schematic diagram showing an example of the structure of display section 1. In FIG. 8, display section 1 has liquid crystal panel 11, horizontal drive circuit 12, sample hold circuit 13, and vertical drive circuit 14.

Liquid crystal panel 11 is an example of the display panel. Liquid crystal panel 11 has a plurality of scanning lines SC; a plurality of signal lines SI that intersects with individual scanning lines SC; and a plurality of pixels P that are located at the intersection of individual scanning lines SC and individual signal lines SI. Thus, pixels P are arranged in a matrix shape. A plurality of pixel lines each of which is composed of a plurality of pixels are arranged along scanning lines SC.

According to this embodiment, it is assumed that individual scanning lines SC extend in the horizontal direction and are arranged in the vertical direction, whereas individual signal lines SI extend in the vertical direction and intersect with individual scanning lines SC.

Each pixel P is composed of a liquid crystal cell and is connected to scanning line SC and signal line SI through transistor T. A gate electrode of transistor TF is connected to scanning line SC; a source electrode thereof is connected to signal line SI; and a drain electrode thereof is connected to pixel P.

Horizontal drive circuit 12, sample hold circuit 13, and vertical drive circuit 14 are composed of a drive section that scans individual pixels P of liquid crystal panel 11 in a predetermined scanning sequence based on an input image signal and displays an image corresponding to the input image signal.

More specifically, horizontal drive circuit 12 starts operating in synchronization with the horizontal synchronization signal for the image signal and outputs a sampling signal that causes the image signal to be sampled in synchronization with an input clock signal to sample hold circuit 13.

Sample hold circuit 13 samples the image signal in synchronization with the sampling signal that is input from horizontal drive circuit 12, holds pixel values of individual scanning lines of the image signal, and outputs pixel voltages corresponding to the pixel values to individual signal lines SI.

Vertical drive circuit 14 applies the pixel voltages that are input from sample hold circuit 13 to pixels P connected to individual scanning lines SC so as to scan pixels P of individual scanning lines SC.

More specifically, vertical drive circuit 14 outputs vertical scanning timing pulses that cause transistors T to be turned on to individual scanning lines SC in a predetermined sequence at timings corresponding to the horizontal synchronous signal and vertical synchronous signal for the image signal, turns on transistors TFT connected to individual scanning lines SC, and thereby applies pixel voltages to individual pixels P.

At this point, vertical drive circuit 14 starts operating in synchronization with the vertical synchronization signal and outputs the vertical scanning timing pulses to individual scanning lines SCN that are in sequence from top to bottom on liquid crystal panel 11. As a result, pixels PX are scanned corresponding to individual scanning lines SCN that are successive from top to bottom on liquid crystal panel 11.

Returning to FIG. 7, the image signal is input from the outside of the image display device to write control circuit 2. Write control circuit 2 stores a plurality of successive frames of the image signal to storage section 3.

According to this embodiment, storage section 3 has two frame memories 3A and 3B. Write control circuit 2 writes a frame to be corrected, namely the current frame, to frame memory 3A and a frame that is immediately preceded by the current frame, namely the next frame, to frame memory 3B.

Motion detection circuit 4 is a detection section that identifies a moving region contained in an original image corresponding to the image signal based on the plurality of frames of the image signal stored in storage section 3 and detects the distance and direction for and in which the moving region moves.

Figure 9:
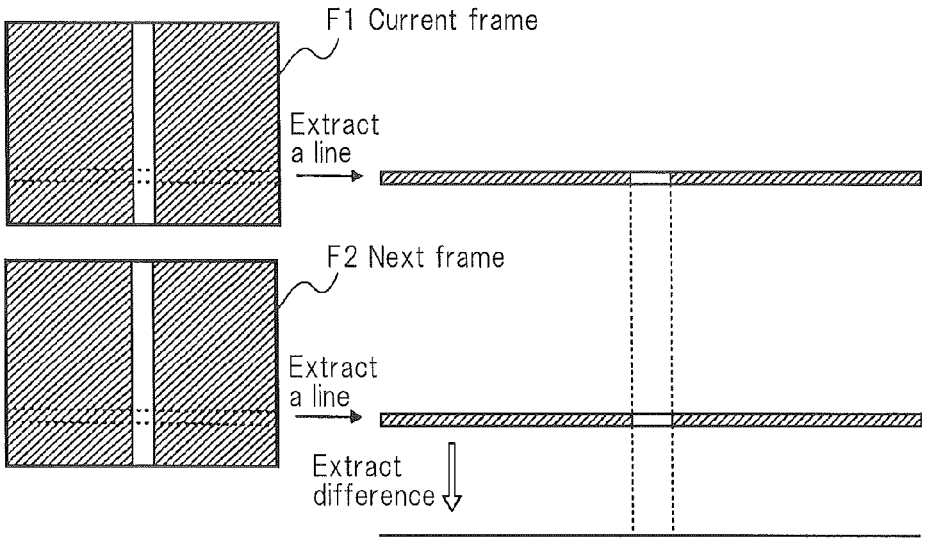
FIG. 9 is a schematic diagram describing an example of a detection process that a motion detection circuit performs.
Figure 10:
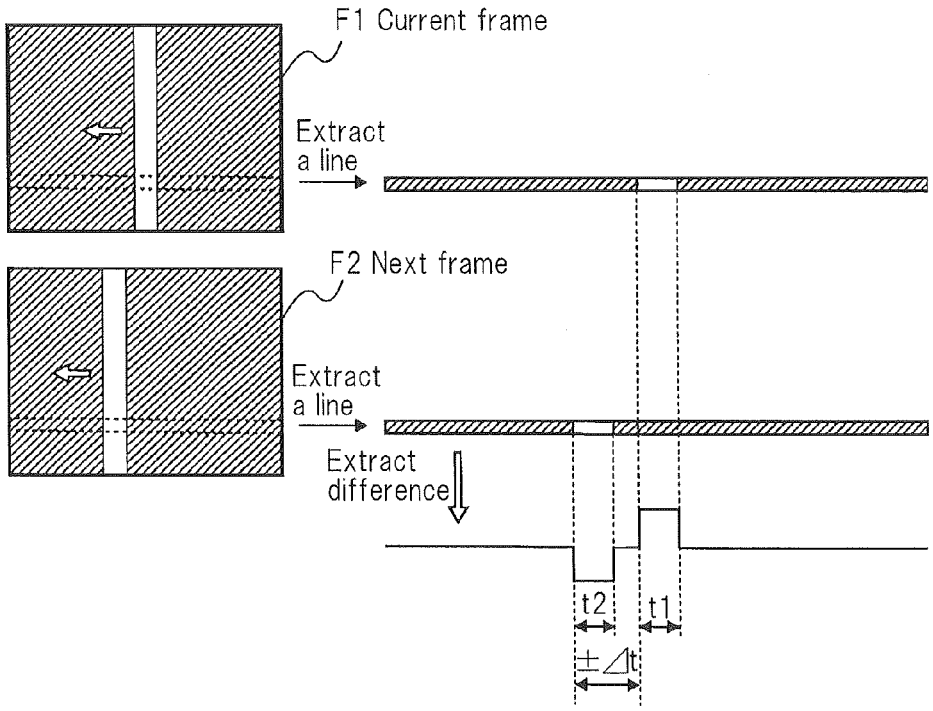
FIG. 10 is a schematic diagram describing another example of the detection process that the motion detection circuit performs.

FIG. 9 and FIG. 10 are schematic diagrams describing an example of a detection process that motion detection circuit 4 performs.

As shown in FIG. 9 and FIG. 10, motion detection circuit 4 extracts pixel values of pixels contained in the same pixel line from both current frame F1 stored in frame memory 3A and next frame F2 stored in frame memory 3B and calculates pixel differences that are the differences of the pixel values of these frames. Thereafter, motion detection circuit 4 determines whether or not all the pixel differences are 0.

As shown in FIG. 9, if all the pixel differences are 0, motion detection circuit 4 determines that there is no moving region.

In contrast, as shown in FIG. 10, if all the pixel differences are not 0, motion detection circuit 4 obtains width t1 of a plus portion of a pixel region where the pixel difference is plus and width t2 of the minus portion of the pixel region where the pixel difference is minus and determines whether or not the width difference that is the difference between width t1 and width t2 is equal to or greater than a predetermined threshold.

If the width difference is less than the threshold, since width t1 is equal to or nearly equal to width t2, motion detection circuit 4 determines that the plus portion and minus portion are moving regions that moves in the horizontal direction and identifies a moving region in current frame F1 and next frame F2 based on the plus portion and minus portion.

For example, motion detection circuit 4 compares the pixel value of each pixel contained in the plus portion and minus portion in current frame F1 with the pixel value of each pixel whose pixel difference is 0 in current frame F1 (hereinafter, the latter pixel value is referred to as the reference pixel value). Thereafter, motion detection circuit 4 identifies the plus portion or minus portion that has a pixel value that is different from the reference pixel value as the moving region in current frame F1. In addition, motion detection circuit 4 identifies the plus portion or minus portion that is different from a moving region in current frame F1 as the moving region in the next frame.

Thereafter, motion detection circuit 4 detects the difference between the position of the moving region in current frame F1 and that in next frame F2 as the moving distance for which the moving region moves. In addition, motion detection circuit 4 detects the direction from the position of the moving region in current frame F1 to the position of the moving region in next frame F2 as the direction in which the moving region moves. In the following, the moving distance is represented by $\Delta t$ and the moving direction is represented by the sign of $\Delta t$. The combination of moving distance and moving direction may be referred to as displacement $\pm\Delta t$.

Motion detection circuit 4 performs the foregoing detection process successively and individually for all pixel lines.

Returning to FIG. 7, image signal correction circuit 5 is a correction section that corrects the image signal based on both displacement $\pm\Delta t$ that motion detection circuit 4 detects and the scanning sequence in which display section 1 scans pixels P and outputs the corrected image signal to sample hold circuit 13 of display section 1 so as to draw the corrected image corresponding to the correction image signal on display section 1.

Figure 11:
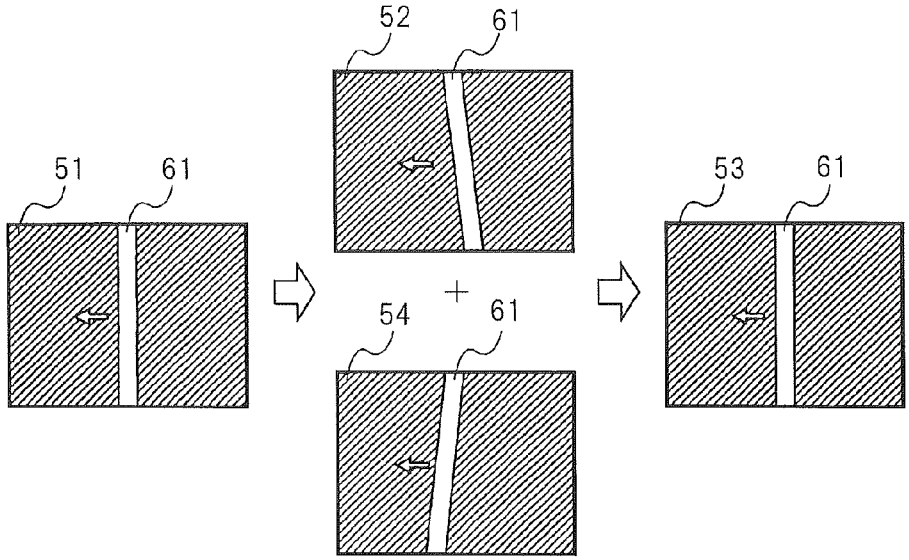
FIG. 11 is a schematic diagram describing a correction process that an image signal correction circuit performs.

FIG. 11 is a schematic diagram describing the correction process that image signal correction circuit 5 performs.

As shown in FIG. 11, it is assumed that in image 51 of an original image signal that has not been corrected, vertical line 61 is moving from right to left on the display screen. In this case, since individual pixels P are scanned corresponding to individual scanning lines SC that are successive from top to bottom on the display screen of display section 1, the lower portion of vertical line 61 is drawn later than the upper portion thereof. Consequently, the viewer sees that the lower portion of vertical line 61 is moving later than the upper portion thereof as image 52.

Thus, image signal correction circuit 5 corrects the image signal such that vertical line 61 is inclined in the moving direction thereof as image 54. Thereafter, image signal correction circuit 5 outputs the image signal of image 54 to the display section. As a result, the viewer sees that as image 53 vertical line 61 is moving without an inclination.

Figure 12:
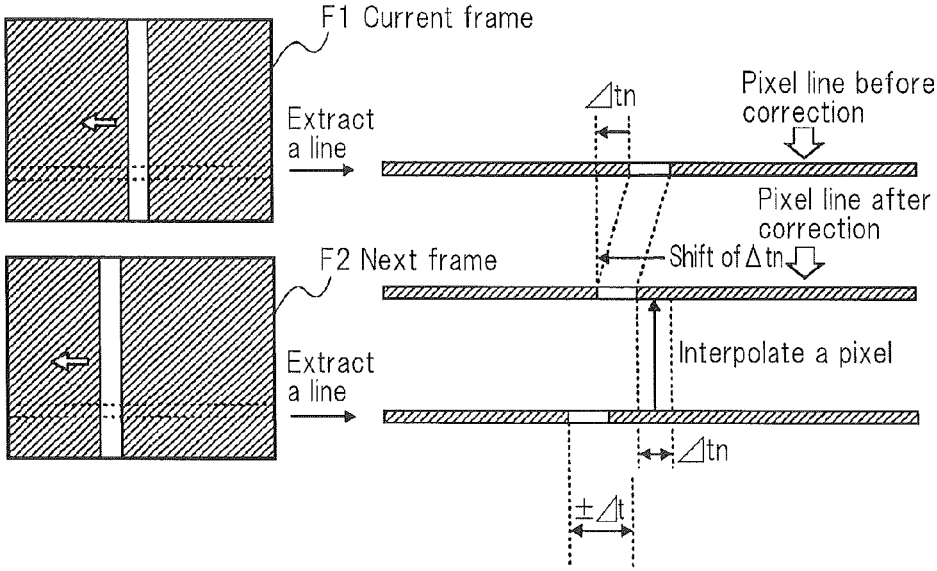
FIG. 12 is a schematic diagram describing in detail the correction process that the image signal correction circuit performs.
Figure 13:
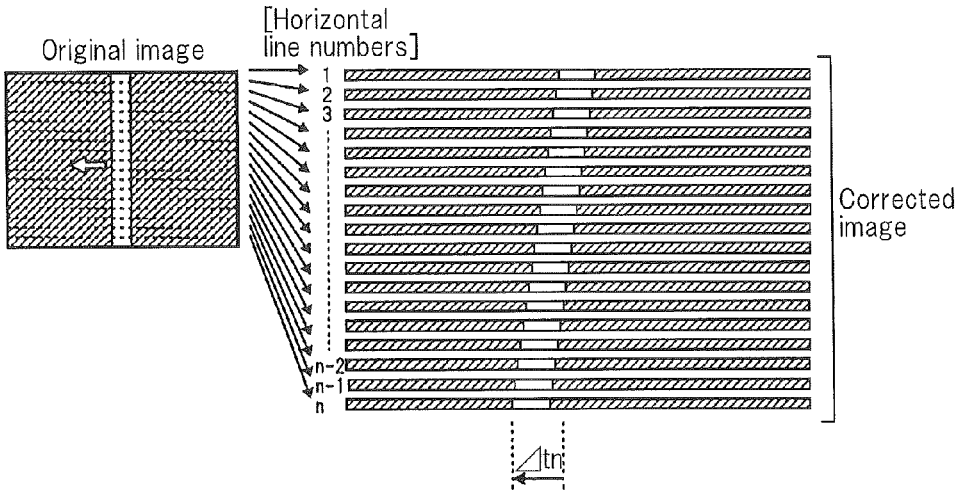
FIG. 13 is a schematic diagram showing an example of a corrected image.
Figure 14:
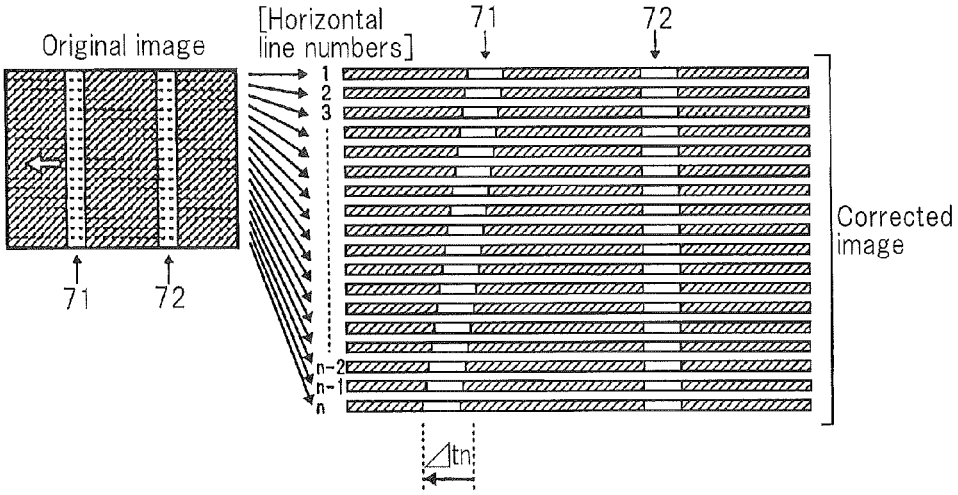
FIG. 14 is a schematic diagram showing another example of a corrected image.

FIG. 12 to FIG. 14 are schematic diagrams describing in detail the correction process that image signal correction circuit 5 performs.

First, as shown in FIG. 12, image signal correction circuit 5 extracts pixel values of pixels contained in the same pixel line from both current frame F1 stored in frame memory 3A and next frame F2 stored in frame memory 3B.

Thereafter, image signal correction circuit 5 corrects the current frame such that the moving region on the pixel line corresponding to the extracted pixel values is shifted by correction distance Δtn corresponding to the moving distance of the moving region and the scanning sequence of the pixel line. At this point, the direction in which the moving region is shifted is the same as the direction in which the moving region moves.

In addition, image signal correction circuit 5 corrects the current frame such that the pixel values of the blank region that occur before the moving region of the current frame is shifted in the current frame match those in the next frame. For example, image signal correction circuit 5 interpolates the blank region of the next frame based on that of the current frame.

Image signal correction circuit 5 performs the foregoing correction process successively and individually for all pixel lines.

According to this embodiment, correction distance Δtn is given by $\Delta tn=\pm\Delta t\times kn$ where kn is a correction coefficient corresponding to scanning sequence. The larger correction coefficient kn, the later is the scanning sequence n becomes. Correction coefficient kn is proportional to scanning sequence n. The proportional coefficient between correction coefficient kn and scanning sequence n depends on the response characteristic of liquid crystal panel 11.

In this case, as shown in FIG. 13, if the vertical line is moving from right to left, since correction distance Δtn is proportional to scanning sequence n, correction distance Δtn increases because the the scanning line number increases on liquid crystal panel 11. Assuming that the number of scanning lines SC is n, they are successively assigned horizontal line numbers 1 to n.

In addition, as shown in FIG. 14, if there are two vertical lines 71 and 72 where vertical line 71 is moving and vertical line 72 is not moving, since only vertical line 71 becomes a moving region, only vertical line 71 is corrected.

Next, the operation of the image display device will be described.

When an image signal is input to write control circuit 2, it writes pixel values of each pixel line of the current frame of the image signal to frame memory 3A and pixel values of each pixel line of the next frame, which is immediately preceded by the current frame, of the image signal to frame memory 3B.

Thereafter, image signal correction circuit 5 corrects pixel values of each pixel line of the current frame written to frame memory 3A and successively outputs corrected pixel values of one pixel line of the current frame to sample hold circuit 13.

When pixel values of one pixel line of the current frame are input to sample hold circuit 13, write control circuit 2 writes pixel values of the same pixel line of the further next frame to the memory region of frame memory 3A. When all the corrected current frames have been input to sample hold circuit 13, the further next frame is written to frame memory 3A. Thereafter, image signal correction circuit 5 corrects pixel values of each pixel line of the next frame written to frame memory 3B with pixel values of each pixel line of the further next frame written to frame memory 3A and successively outputs corrected pixel values of the pixel line of the next frame to sample hold circuit 13.

Figure 15:
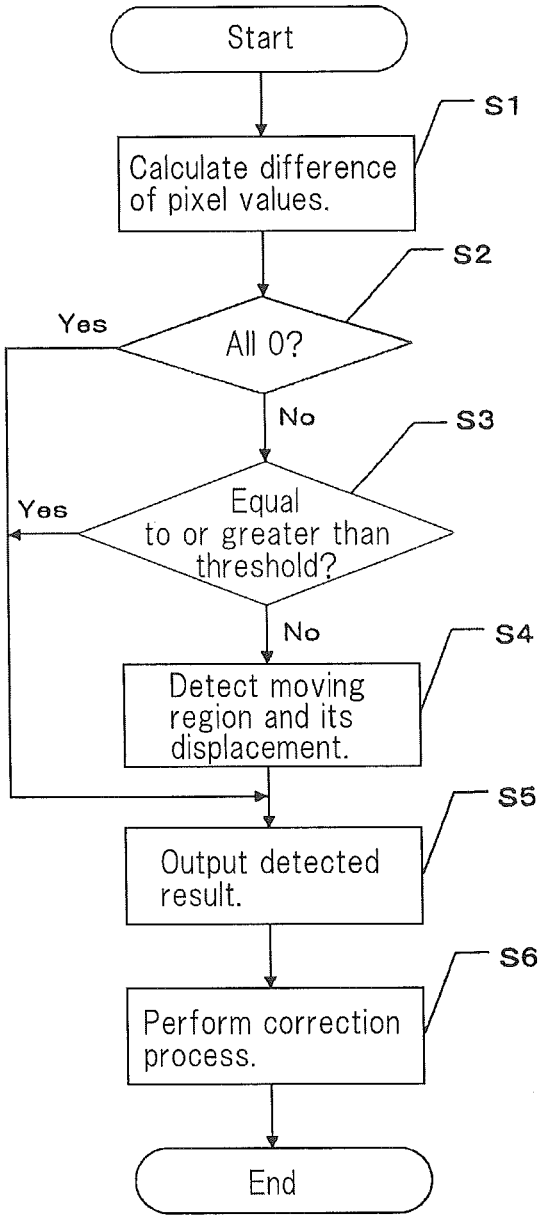
FIG. 15 is a flow chart describing an example of an operation of an image display device according to an embodiment of the present invention.

FIG. 15 is a flow chart describing the operation of the image display device that corrects pixel values of one pixel line of the current frame.

First, motion detection circuit 4 extracts pixel values of pixels of one pixel line of current frame F1 stored in frame memory 3A and those of the same pixel line of next frame F2 stored in frame memory 3B and calculates pixel differences of these pixels (at step S1).

Thereafter, motion detection circuit 4 determines whether or not all the pixel differences are 0 (at step S2).

If all the pixel differences are not 0, motion detection circuit 4 obtains width t1 of the plus portion of the pixel line and width t2 of the minus portion of the pixel line and determines whether or not the width difference between width t1 and width t2 is equal to or greater than a predetermined threshold (at step S3).

If the width difference is less than the threshold, motion detection circuit 4 identifies a moving region based on the plus portion and minus portion and detects the displacement of the moving region (at step S4).

If all the pixel differences are 0 at step S2, if the width difference is equal to or greater than the threshold at step S4 or if step S5 has been completed, motion detection circuit 4 generates a detection result signal that represents the detected result of the moving region and outputs the detection result signal to image signal correction circuit 5 (at step S5).

If all the pixel differences are 0 at step S1 and the width difference is equal to or greater than the threshold at step S3, the detection result signal denotes that there is no moving region. If step 4 has been completed, the detection result signal represents the moving region (position and width) and the displacement of the moving region.

When the detection result signal is input to image signal correction circuit 5, it extracts a plurality of pixel values extracted by motion detection circuit 4 at step S1 from both current frame F1 stored in frame memory 3A and next frame F2 stored in frame memory 3B. Thereafter, image signal correction circuit 5 corrects the extracted pixel values of the current frame based on the detection result signal and the extracted pixel values of the next frame, generates a corrected image signal, and outputs the corrected image signal to sample hold circuit 13 of display section 1 (at step S6).

At this point, if the detection result signal denotes that there is no moving region, image signal correction circuit 5 treats the original pixel values of the current frame as those that have been corrected. In contrast, if the detection result signal represents the moving region and the displacement, image signal correction circuit 5 corrects the pixel values of the current frame based on the moving region and displacement represented by the detection result signal and the extracted pixel values of the next frame.

As described above, according to this embodiment, since the image signal is corrected based on the moving distance and moving direction of the moving region and the pixel scanning sequence, the image deterioration that occurs due to the pixel scanning sequence can be eliminated.

In the foregoing embodiments, the illustrated structures are just examples. Thus, the present invention is not limited to these structures.

Figure 16:
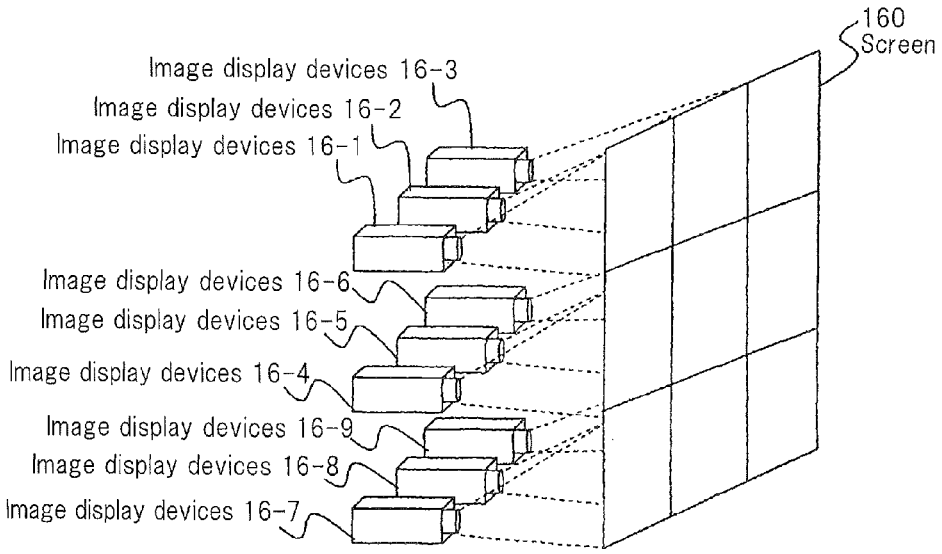
FIG. 16 is a schematic diagram showing an example of an image display system that is provided with a plurality of image display devices according to an embodiment of the present invention.

For example, the image display device shown in FIG. 1 may be applied to image display devices 16-1 to 16-9 of an image display system shown in FIG. 16. In this image display system, image display devices 16-1 to 16-9 are located such that images displayed on image display devices 16-1 to 16-9 are arranged on a display region of screen 160. The image display system displays images drawn by image display devices 16-1 to 16-9 as one display image. Although the image display system shown in FIG. 16 is provided with nine image display devices, the image display system may be provided with a plurality of image display devices. FIG. 16 exemplifies a projection type image display device as individual image display devices. However, individual image display devices may be monitors that have a display screen and display an image thereon.

The display panel may be a panel other than a liquid crystal panel.

DESCRIPTION OF REFERENCE NUMERALS

1 Display section
2 Write control circuit
3 Storage section
3A, 3B Frame memories
4 Motion detection circuit
5 Image signal correction circuit
11 Liquid crystal panel
12 Horizontal drive circuit
13 Sample hold circuit
14 Vertical drive circuit
16-1 to 16-9 Image display devices
P Pixel
SC Scanning line
SI Signal line
T Transistor

What is claimed is:

1. An image display device that is provided with a display panel having a plurality of pixels and that scans said plurality of pixels in a predetermined scanning sequence and draws an image, the image display device comprising:

a detection section that identifies a moving region contained in an image corresponding to an input image signal composed of a plurality of frames and detects a moving distance and a moving direction for and in which the moving region moves;

a correction section that corrects said image signal based on a detected result of said detection section and the scanning sequence in which individual pixels in said moving region are scanned; and a drive section that scans said plurality of pixels in said scanning sequence based on a corrected image signal that is an image signal corrected by said correction section and that draws a corrected image corresponding to said corrected image signal, wherein said plurality of pixels are arranged in a matrix shape, wherein said drive section scans said plurality of pixels of pixel lines each of which includes pixels arranged in a predetermined direction, wherein said detection section detects a region that moves in said predetermined direction for each of said pixel lines as said moving region, wherein said correction section corrects said image signal such that the moving region of each of said pixel lines is shifted in said moving direction for a corrected distance corresponding to said moving distance and said scanning sequence, wherein said detection section compares a predetermined frame of said image signal with a next frame immediately preceded by said predetermined frame and detects a moving region that occurs from said predetermined frame as said moving region until said next frame, and wherein said correction section corrects said image signal such that said moving region in said predetermined frame is shifted and such that pixel values of a blank region that occurs before the moving region includes shifted match pixel values of the same blank region of said next frame.

2. The image display device as set forth in claim 1, wherein said correction distance is proportional to said scanning sequence.

3. An image display system provided with a plurality of image display devices as set forth in claim 1.

4. An image signal processing method for an image display device that is provided with a display panel having a plurality of pixels and that scans said plurality of pixels in a predetermined scanning sequence and draws an image, the image signal processing method comprising:

identifying a moving region contained in an image corresponding to an input image signal composed of a plurality of frames and detecting a moving distance and a moving direction for and in which the moving region moves;

correcting said image signal based on the detected result and the scanning sequence in which individual pixels in said moving region are scanned; and scanning said plurality of pixels in said scanning sequence based on a corrected image signal that is a corrected image signal, and drawing a corrected image corresponding to said corrected image signal, wherein said plurality of pixels are arranged in a matrix shape, wherein said scanning scans said plurality of pixels of pixel lines each of which include pixels arranged in a predetermined direction, wherein said identifying detects a region that moves in said predetermined direction for each of said pixel lines as said moving region, wherein said correcting corrects said image signal such that the moving region on each of said pixel lines is shifted in said moving direction for a corrected distance corresponding to said moving distance and said scanning sequence, wherein said identifying compares a predetermined frame of said image signal with a next frame immediately preceded by said predetermined frame and detects, from said predetermined frame, a moving region that occurs as said moving region until said next frame, and wherein said correcting corrects said image signal such that said moving region in said predetermined frame is shifted and such that pixel values of a blank region that occurs before the moving region includes shifted match pixel values of the same blank region of said next frame.

5. An image display device that is provided with a display panel having a plurality of pixels and that scans said plurality of pixels in a predetermined scanning sequence and draws an image, the image display device comprising:

a detection section that identifies a moving region contained in an image corresponding to an input image signal composed of a plurality of frames and that detects a moving distance and a moving direction for and in which the moving region moves;

a correction section that corrects said image signal based on a detected result of said detection section, and the scanning sequence in which individual pixels in said moving region are scanned; and a drive section that scans said plurality of pixels in said scanning sequence based on a corrected image signal that is an image signal corrected by said correction section and that draws a corrected image corresponding to said corrected image signal, wherein said detection section compares a predetermined frame of said image signal with a next frame immediately preceded by said predetermined frame and detects, from said predetermined frame, a moving region that occurs as said moving region until said next frame, and wherein said correction section corrects said image signal such that said moving region in said predetermined frame is shifted and such that pixel values of a blank region that occurs before the moving region includes shifted match pixel values of the same blank region of said next frame.

6. The image display device as set forth in claim 5, wherein said plurality of pixels are arranged in a matrix shape, wherein said drive section scans said plurality of pixels of pixel lines each of which includes pixels arranged in a predetermined direction, and wherein said detection section detects a region that moves in said predetermined direction for each of said pixel lines as said moving region.

7. The image display device as set forth in claim 5, wherein said correction distance is proportional to said scanning sequence.

8. An image display system provided with a plurality of image display devices as set forth in claim 5.

9. An image signal processing method for an image display device that is provided with a display panel having a plurality of pixels and that scans said plurality of pixels in a predetermined scanning sequence and that draws an image, the image signal processing method comprising:

identifying a moving region contained in an image corresponding to an input image signal composed of a plurality of frames, and detecting a moving distance and a moving direction for and in which the moving region moves;

correcting said image signal based on the detected result and the scanning sequence in which individual pixels in said moving region are scanned; and scanning said plurality of pixels in said scanning sequence based on a corrected image signal that is a correcting image signal, and drawing a corrected image corresponding to said corrected image signal, wherein said identifying compares a predetermined frame of said image signal with a next frame immediately preceded by said predetermined frame and detects, from said predetermined frame, a moving region that occurs as said moving region until said next frame, and wherein said correcting corrects said image signal such that said moving region in said predetermined frame is shifted and such that pixel values of a blank region that occurs before the moving region includes shifted match pixel values of the same blank region of said next frame.

* * * * *